United States Patent [19]

Berggren

[11] Patent Number: 4,684,073

[45] Date of Patent: Aug. 4, 1987

[54] APPARATUS FOR THICKENING AND REFINING FIBRE-PULP SUSPENSIONS

[75] Inventor: Torsten L. Berggren, Nässjö, Sweden

[73] Assignee: Thune-Eureka A/S, Lier, Norway

[21] Appl. No.: 786,399

[22] PCT Filed: Dec. 5, 1984

[86] PCT No.: PCT/SE84/00416

§ 371 Date: Oct. 9, 1985

§ 102(e) Date: Oct. 9, 1985

[87] PCT Pub. No.: WO85/03730

PCT Pub. Date: Aug. 29, 1985

[30] Foreign Application Priority Data

Feb. 15, 1984 [SE] Sweden ..... 8400824

[51] Int. Cl.[4] ..... D21D 1/30; B02C 7/00

[52] U.S. Cl. ..... 241/247; 162/261; 241/261.2

[58] Field of Search ..... 162/261; 241/247, 261.2; 100/74

[56] References Cited

U.S. PATENT DOCUMENTS

| | | | |
|---|---|---|---|
| 4,082,233 | 4/1978 | Reinhall | 241/247 |
| 4,163,525 | 8/1979 | Reinhall | 241/247 |
| 4,202,505 | 5/1980 | Ruuskanen | 241/247 |
| 4,220,290 | 9/1980 | Johansson | 241/247 |
| 4,269,365 | 5/1981 | Berggren | 241/261.2 |
| 4,283,252 | 8/1981 | Reinhall | 162/23 |
| 4,286,512 | 9/1981 | Berggren | 100/112 |

FOREIGN PATENT DOCUMENTS 40371 11/1914 Sweden .

*Primary Examiner*—S. Leon Bashore
*Assistant Examiner*—K. M. Hastings
*Attorney, Agent, or Firm*—Sughrue, Mion, Zinn, Macpeak and Seas

[57] ABSTRACT

Apparatus for thickening, or de-watering, and refining fibre-pulpsuspensions include a screw-press thickener (1) and a refiner (2). In order to prevent air from entering the pulp and to provide a simpler arrangement, the outfeed end of the screw-press thickener (1) is connected directly to the infeed end of the refiner (2), therewith also to serve as an infeed screw to the refiner (2). In this respect the thickener (1) has a screening jacket (5) which embraces the screw (6). The screening jacket has at least one section which converges in the pulp feed direction, to achieve in the screw-press (1) a press effect required for de-watering the pulp while at the same time achieving the requisite reduction in diameter of the screening jacket (5) for connection to the refiner (2).

7 Claims, 1 Drawing Figure

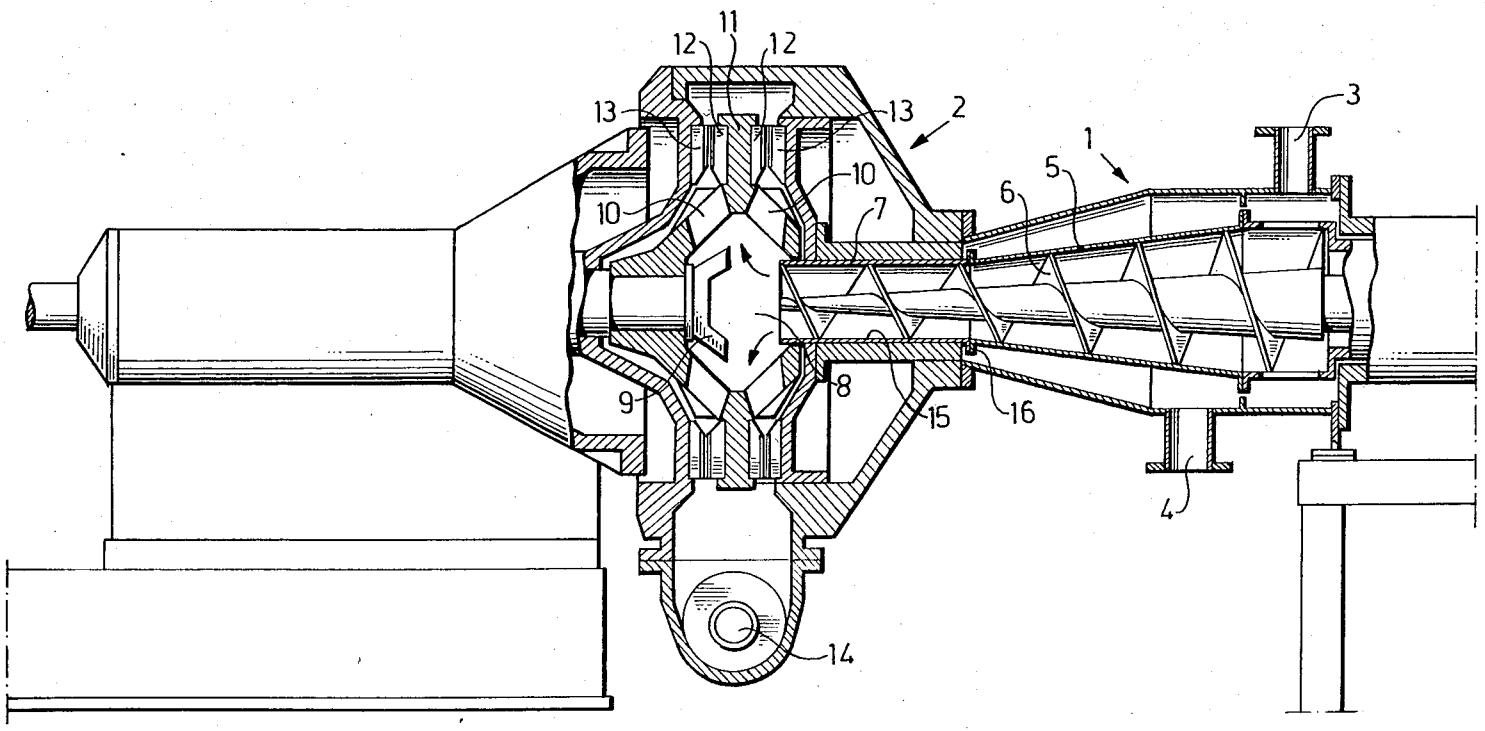
1
2
3
4
5
6
7
8
9
10
10
11
12
12
13
13
14
15
16

APPARATUS FOR THICKENING AND REFINING FIBRE-PULP SUSPENSIONS

FIELD OF INVENTION

The present invention relates to apparatus for thickening, i.e. de-watering, and refining fibre-pulp suspensions, comprising a screw-press thickener or dewaterer and a refiner.

BACKGROUND ART

In present day fibre-pulp processing techniques, the pulp is thickened in a separate unit, for example a screw-press thickener, while refinement of the pulp is effected in a unit separate from the thickener, for example a disc refiner. Consequently, a screw feeder is required for transporting pulp from the pulp-thickening unit to the pulp-refining unit, this screw-feeder also serving as a refiner-infeed screw. In an arrangement such as this, the pulp is liable to absorb air during its passage from the outlet of the thickener to the inlet of the refiner, among other things due to the fact that the pressure created within the pulp in the screw-press thickening unit and the extent to which the pulp has been compressed therein cannot be maintained during transfer of the pulp by the feed screw. All air introduced into the pulp subsequent to it thickening has a deleterious effect on the subsequent treatment stages, however, and consequently the aforedescribed method of transferring pulp to the feed screw is encumbered with serious disadvantages.

Another disadvantage with present day apparatus arrangements of this kind, is that they require the provision of an additional unit, namely the combined conveying and infeed screw, which increases costs relating to initial investment, operation and maintenance.

In addition, each additional unit presents a stoppage hazard, and makes it difficult to sustain or reach a uniform pulp flow to the refiner. Another obvious disadvantage is that each additional unit requires a corresponding amount of space to be made available.

The prime object of the present invention is to provide an apparatus of the aforementioned kind intended for thickening, i.e. de-watering, and refining fibre-pulp suspensions, in which the aforementioned disadvantages are eliminated.

The general solution to the problem upon which the invention is based resides in the understanding that all the aforementioned disadvantages can be eliminated by connecting the screw-press thickener directly to the refiner, in the absence of an interconnecting combined pulp-conveying and infeed screw. In this way there is provided a fully closed system in which the pressure created in the pulp in the screw-press thickener and the extent to which the pulp is compressed therein can be maintained right up to the point at which the pulp is fed into the refiner. In this way problems related to the introduction of air into the pulp and the necessity of using a separate unit are eliminated.

DISCLOSURE OF THE INVENTION

A particular characteristic of an apparatus of the kind described in the introduction and based on this understanding is that the outfeed end of the screw-press thickener is connected directly to the infeed end of the refiner so as to function also as a screw infeed to the refiner, and in that the screw of the screw-press thickener is encased in a screening jacket of which at least a part thereof converges in the feed direction of the pulp, to achieve the requisite press effect for de-watering the pulp in the screw press while obtaining, at the same time, a reduction in the diameter of the screening jacket to enable the thickener to be connected to the refiner.

In a preferred embodiment there is used a screw-press thickener of the kind described, for example, in U.S. Pat. No. 4,286,512, because the drainage of free water resulting from the centrifugal forces generated by a rotating screening drum can be effected in said thickener with a high degree of efficiency. This means that the thickener can be made short in length and thus the screw and screening drum, for example, may be incorporated in a single free-bearing unit supported at its one end. In addition hereto, the requisite press effect in the thickener can be achieved by using a screening drum which converges over at least a part thereof in the direction of pulp feed, which means that the drum may be given a relatively small diameter at the outfeed end thereof, which enables it to be connected directly to a disc refiner of suitable construction, for example a refiner of the twin-flow type described in U.S. Pat. No. 4,269,365.

A disc refiner of this kind having a collecting chamber located peripherally around the refining discs affords important advantages over other types of disc refiners, and renders it particularly suitable for use together with a screw press in accordance with the aforegoing. One of these advantages is that the rear sides of respective discs do not contact the pulp subsequent to the pulp having passed the beating zone, such contact resulting in high energy losses as a result of the turbulence created in the pulp.

The screw-press thickener may also be of the kind having a stationary screening drum, since this design is of simpler and less expensive manufacture, and has a better function for certain purposes. Such a thickener is cheaper to manufacture because all components relating to rotational movement of the drum, for journalling the drum and guiding the same are omitted. This design also functions more advantageously when treating easy draining pulps with which compression of the pulp in the progressively decreasing volume of the screw press in the feed direction of the screw is sufficient to attain the desired final dry solids content of the pulp at the inlet to the refiner. With easy draining pulps of this kind, the final dry solids content of the pulp can be controlled more simply, by utilizing solely the compression effect in the screw. It is not then necessary to take into account the drainage of the free water in the pulp obtained as a result of the centrifugal forces which are depending on the rotational speed of the screening drum.

With easy draining pulps, when the volume reduction of the screw, the screw speed, the concentration of the incoming pulp and the amount of incoming pulp per unit of time are known, the exiting dry solids content of the pulp can be readily anticipated and controlled to desired values, by changing the speed of the screw, this change in speed standing in proportion to the degree of compression of the pulp in the screw.

Preferably, the core of the screw also presents at least one section having a form which converges in the feed direction. The converging section of the screening jacket is suitably connected with a substantially cylindrical section, intended for connecting the thickener to the refiner. The cylindrical section of the jacket suitably has a dense or impervious jacket surface and extends into the infeed passage of the refiner.

The cylindrical section may also comprise an extension of the screening jacket. Alternatively, the cylindrical section may comprise a part of the infeed passage of the refiner.

BRIEF DESCRIPTION OF THE DRAWING

The invention will now be described in more detail with reference to the accompanying drawing, which illustrates by way of example a combination of a screw-press thickener, or de-waterer, having a rotating screen drum connected directly to a disc refiner.

DESCRIPTION OF A PREFERRED EMBODIMENT

In the drawing, reference numeral 1 identifies a screw-press thickener of the general kind described in the aforementioned U.S. Pat. No. 4,286,512, while reference numeral 2 identifies a disc refiner of the kind described in the aforementioned U.S. Pat. No. 4,269,365. The screw-press thickener or de-waterer 1 has a pulp inlet 3 and an outlet 4 for water pressed from the pulp. A screening jacket 5 is provided with drainage holes and is arranged to rotate at a speed sufficiently high to obtain, as a result of the centrifugal force, an effective draining of free water present in the pulp and water pressed from the pulp, although the speed of the drum should not be of such magnitude as to cause bound water in the pulp from being pressed therefrom to any appreciable extent as a result of the centrifugal forces generated by excessive rotation of the drum. The press forces are obtained by the fact that a section of the screening jacket 5 has a form which converges in the feed direction. In the illustrated embodiment, the core of the screw 6 also converges in the feed direction.

The pulp is thickened or de-watered extremely efficiently in a screw-press of this design having a rotating screening jacket, and as a result of this efficiency the screw-press can be made relatively short, enabling it to be free-bearing and supported solely at its one end, as illustrated in the FIGURE.

The disc refiner 2 is of the kind having a central inlet passage 7 which exits in a cavity 8, in which there is arranged a propeller-like means 9 for degrading and distributing the incoming material. The material decomposed by the propeller 9 is thrown out through holes 10 and passed to the beating zones between annular beating means 12 arranged on a rotor 11 and opposing, stationary annular beating means 13. The refined pulp is then discharged with aid of a screw 14.

For a more detailed description of the screw-press thickener and the disc refiner reference is made to the aforementioned U.S. Patents.

The essential novelty of the aforedescribed arrangement lies in the fact that the screw-press thickener has been modified in a manner which enables it to be connected directly to the central inlet passage of the refiner, therewith enabling the screw to also serve as an infeed screw. From the aspect of pulp quality, the most important advantage afforded by such an arrangement is that the pulp, which is compressed in the screw-press, is transferred to the refiner without losing any of the compression, and that air is unable to penetrate the pulp. From a space-saving and cost-saving aspect, the arrangement obviously has many important advantages, since it enables the use of a separate screw conveyor and screw feeder to be dispensed with. An apparatus according to the invention is also extremely compact, and all rotation shafts can be located on one and the same level. As can be seen in the drawing the infeed passage 7 is unrestricted and has a substantially constant diameter.

The aforedescribed embodiment is intended solely as a preferred embodiment of the invention and can be modified in several respects within the scope of the invention. For example, the aforedescribed screw-press thickener may be connected to a refiner of any selected design. In the illustrated embodiment, the screw of the screw-press has a form which converges in the feed direction along the whole of the length of the screw. It will be understood, however, that screws having circular cylindrical cores or a core having both circular-cylindrical sections and converging sections can be used instead.

In order to reduce the dimensions of the screening jacket at the location of connection to the disc refiner, it is necessary for the screening jacket to present at least one converging section, although this section may merge with an imperforate circular-cylindrical section 15 extending into the infeed passage of the disc refiner. This section 15 may either be arranged for rotation together with the remaining part of the screening jacket 5, or may be stationarily arranged, in which case it can be replaced by the walls of the infeed passage of the refiner, for example. The screw 6, however, should extend into the distributing chamber 8 in the refiner. Suitable sealing means must be mounted between the screening jacket 5 and the refiner 2 when the screening jacket is rotatable or, when the circular-cylindrical section 15 is stationarily arranged, between this section and the remainder of the screening jacket 5. In this latter case, the seal suitably comprises a labyrinth seal 16. The screening jacket may converge over the whole of its length.

As mentioned in the introduction to the description, it may be more advantageous from the aspect of cost, space and maintenance, to use a variant of the screw-press thickener in which the screening drum is stationary. With respect to the treatment of certain types of pulp, the design affords a more purposeful function. Exhaustive tests have confirmed, however, that in the case of more easy draining pulp qualities, the final solids content of the pulp can be more readily anticipated and controlled with a pure compression of the pulp without simultaneous centrifugal drainage of the free water present in the pulp.

Thus, the invention is not restricted to the described embodiment having rotating drum, and can be modified in various respects within the scope of the following claims.

I claim:

1. Apparatus for thickening and refining fibre-pulp suspensions, comprising: a screw-press thickener (1) and a disc refiner (2), wherein a screw (6) of the thickener is surroundingly embraced by a screening jacket (5) having at least one section which converges in a feed direction to achieve a necessary compression effect for de-watering a fibre-pulb suspension in the screw-press and to reduce the diameter of the screening jacket, wherein a reduced diameter outfeed end of the screw-press thickener is directly connected to an inlet end of an unrestricted, substantially constant diameter infeed passage (7) of the refiner (2) leading to a central distribution cavity (8) within discs (12, 13) of the refiner, wherein the screw (6) of the screw-press thickener extends completely through said infeed passage (7) to positively feed the de-watered fibre-pulp suspension directly into the distribution cavity of the refiner, and wherein the screw has an inwardly tapering core within the infeed passage such that the effective cross-sectional area of said passage increases in the feed direction to facilitate the flow of the de-watered fibre-pulp suspension.

2. Apparatus according to claim 1, wherein the screening jacket (5) of the thickener (1) is rotatable and arranged to rotate at a speed sufficiently high to obtain, as a result of centrifugal force, an effective draining through the jacket of free water present in the suspension and water pressed from said suspension.

3. Apparatus according to claim 1 or claim 2, wherein the refiner is a twin-flow disc refiner (2) having a collecting chamber located peripherally around the discs.

4. Apparatus according to claim 3, wherein the converging section of the screening jacket (5) is connected with a substantially cylindrical section (15) which is connected to the refiner (2).

5. Apparatus according to claim 4, wherein said cylindrical section (15) has a fluid impervious cylindrical surface and extends into the infeed passage (7) of the refiner (2).

6. Apparatus according to claim 5, wherein the cylindrical section (15) is an extension of the screening jacket (5).

7. Apparatus according to claim 4, wherein the cylindrical section (15) comprises a part of the infeed passage (7) of the refiner (2).

* * * * *